US011035096B1

(12) United States Patent
Bunting et al.

(10) Patent No.: US 11,035,096 B1
(45) Date of Patent: Jun. 15, 2021

(54) CONSTRUCTION EQUIPMENT AND METHODS

(71) Applicants: Nathan Bunting, Red Bluff, CA (US); Nate Stephens, Rathdrum, ID (US)

(72) Inventors: Nathan Bunting, Red Bluff, CA (US); Nate Stephens, Rathdrum, ID (US)

( * ) Notice: Subject to any disclaimer, the term of this patent is extended or adjusted under 35 U.S.C. 154(b) by 199 days.

(21) Appl. No.: 15/936,144

(22) Filed: Mar. 26, 2018

Related U.S. Application Data

(60) Provisional application No. 62/478,528, filed on Mar. 29, 2017.

(51) Int. Cl.

| | |
|---|---|
| ***E02F 3/30*** | (2006.01) |
| ***E02F 3/96*** | (2006.01) |
| ***E02F 3/32*** | (2006.01) |
| ***E02F 9/16*** | (2006.01) |
| ***E02F 3/38*** | (2006.01) |
| ***E02F 9/02*** | (2006.01) |
| ***E21B 7/00*** | (2006.01) |
| ***E21B 7/02*** | (2006.01) |

(Continued)

(52) U.S. Cl.

CPC ..... *E02F 3/964* (2013.01); *E02F 3/30* (2013.01); *E02F 3/32* (2013.01); *E02F 3/38* (2013.01); *E02F 3/413* (2013.01); *E02F 3/963* (2013.01); *E02F 9/028* (2013.01); *E02F 9/16* (2013.01); *E02F 9/166* (2013.01); *E04H 12/347* (2013.01); *E21B 7/005* (2013.01); *E21B 7/024* (2013.01); *E21B 7/027* (2013.01); *E02F 3/34* (2013.01); *E21B 7/028* (2013.01)

(58) Field of Classification Search

CPC . E02F 3/30; E02F 3/384; E02F 3/3622; E02F 3/425; E02F 3/963; E02F 5/06; E02F 5/102; E02F 3/32; E02F 3/34; E02F 3/3604; E02F 3/3414; E02F 3/964; E21B 7/02; E21B 7/022; E21B 7/024; E21B 7/028; E21B 15/04; E21B 19/087; B66F 9/0655; B66F 11/044; B66C 1/58; B66C 1/585

USPC ..... 173/28, 184, 185, 193, 44, 46; 405/104, 405/154.1, 180; 37/105, 106, 370, 403, 37/468; 414/685, 686, 697, 23

See application file for complete search history.

(56) References Cited

U.S. PATENT DOCUMENTS 2,846,094 A * 8/1958 Pilch ..... E02F 3/425 414/686
3,333,717 A * 8/1967 Scaperotto ..... E02F 3/963 414/741

(Continued)

*Primary Examiner* — Scott A Smith
(74) *Attorney, Agent, or Firm* — Wells St. John P.S.

(57) ABSTRACT

Construction equipment is provided that can include: a transport assembly operably supporting a platform, the platform having a leading edge opposing a rearward edge, the leading edge associated with a first direction of the transport assembly, and the rearward edge associated with a second direction of the transportation assembly; an operator cab above the platform and aligned closer to the leading edge than the rearward edge; an engine above the platform and aligned closer to the rearward edge than the leading edge; and a boom pivotably attached above the platform closer to the rearward edge than the leading edge, the boom being movable between a first position fully extended and a second position fully raised. Utility line pole placement and/or removal construction methods are provided that can include extending an extension assembly having a banana boom from a transport assembly to couple with a utility line pole.

3 Claims, 14 Drawing Sheets

(51) Int. Cl.

| | |
|---|---|
| ***E02F 3/413*** | (2006.01) |
| ***E04H 12/34*** | (2006.01) |
| *E02F 3/34* | (2006.01) |

(56) References Cited

U.S. PATENT DOCUMENTS 3,604,533 A * 9/1971 Eckels ..... B66F 11/046 182/46
3,606,048 A * 9/1971 Long ..... E02F 3/384 414/560
3,631,991 A * 1/1972 Wacht ..... E21B 19/087 414/23
3,690,387 A * 9/1972 Dixon ..... B66C 23/86 173/193
3,937,339 A * 2/1976 Geis ..... B60G 17/005 414/697
4,580,797 A * 4/1986 Ericsson ..... B62D 49/08 280/5.508
4,641,716 A * 2/1987 Sjalander ..... E21B 7/028 175/62
4,890,958 A * 1/1990 Dancer ..... E02F 5/102 37/105
5,171,124 A * 12/1992 Foster ..... E02F 3/30 212/302
5,558,169 A * 9/1996 Madgwick ..... E21B 7/022 173/185
6,193,440 B1 * 2/2001 Pidgeon ..... E02F 5/06 37/106
6,301,811 B1 * 10/2001 Gilmore, Jr. ..... E02F 3/3622 37/468
6,336,784 B1 * 1/2002 Monaghan ..... B66F 9/0655 180/272
6,494,515 B1 * 12/2002 Kalbfleisch ..... B66C 1/58 294/104
6,527,063 B2 * 3/2003 Rust ..... E21B 7/024 173/193
7,625,165 B2 * 12/2009 Bunting ..... B66C 1/585 173/28
8,103,418 B2 * 1/2012 Osswald ..... B62D 21/14 187/224
8,539,699 B2 * 9/2013 Ramun ..... B23D 31/008 37/403
9,434,586 B2 * 9/2016 Ross, Jr. ..... B66F 11/044
2014/0031977 A1 * 1/2014 Goldenberg ..... B25J 9/08 700/245

* cited by examiner

CONSTRUCTION EQUIPMENT AND METHODS

CROSS REFERENCE TO RELATED APPLICATION

This application claims priority to U.S. Provisional Patent Application Ser. No. 62/478,528 filed Mar. 29, 2017, entitled "Construction Equipment and Methods", the entirety of which is incorporated by reference herein.

TECHNICAL FIELD

The technical field of the disclosure is construction equipment and methods, particularly, utility pole construction equipment and methods.

BACKGROUND

Throughout the world, utilities are still provided via lines stretching between utility poles. These utility poles typically are constructed of single member wood construction, and they need to be placed at predetermined points to create spans between poles, and these points are typically in difficult to reach locations. For example, many utility poles can stretch across vast regions, mountainous and/or forested regions, and other utility spans can stretch within urban areas or even semi-urban areas to provide power and other utilities for commercial and/or residential purposes.

These utility spans need to be originally placed as well as repaired from time to time when storms and/or other unforeseen circumstances occur, and to do so requires heavy construction equipment.

The present disclosure provides construction equipment and methods that can be used to transport, remove, and/or place utility poles, for example.

SUMMARY OF THE DISCLOSURE

Construction equipment is provided that can include: a transport assembly operably supporting a platform, the platform having a leading edge opposing a rearward edge, the leading edge associated with a first direction of the transport assembly, and the rearward edge associated with a second direction of the transportation assembly; an operator cab above the platform and aligned closer to the leading edge than the rearward edge; an engine above the platform and aligned closer to the rearward edge than the leading edge; and a boom pivotably attached above the platform closer to the rearward edge than the leading edge, the boom being movable between a first position fully extended and a second position fully raised.

Utility line pole placement and/or removal construction methods are provided that can include extending an extension assembly having a banana boom from a transport assembly to couple with a utility line pole.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Figure 1:
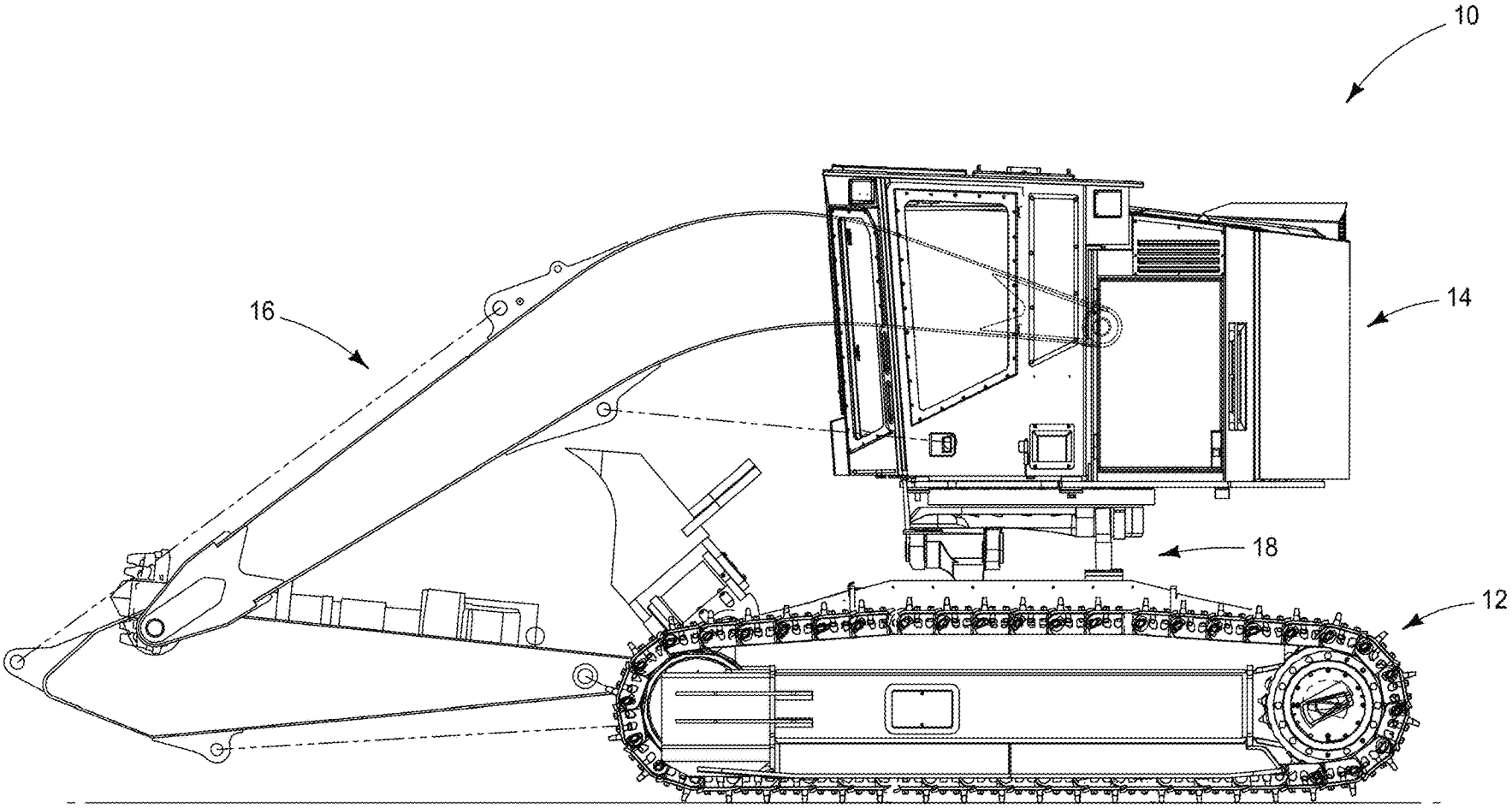
FIG. 1 is construction equipment according to an embodiment of the disclosure.

The construction equipment and methods of the present disclosure will be described with reference to FIGS. 1 through 14. Referring first to FIG. 1, construction equipment 10 is shown that includes a track assembly 12 supporting a cab and power unit 14 that is placed on a platform 18. Extending from platform 18 is extension assembly 16. Power unit 14 can be considered an engine and it may be a hydraulic compressor. Track assembly 18 can be a transport assembly and need not include tracks but include wheels and/or a combination of the both.

Platform 18 can extend and rotate from track 12 and provide for self-leveling of cab 14 above track 12. Construction equipment 10 may be larger or smaller depending on the application. Platform 18 can have a leading edge associated with a first direction of the transport assembly, and rearward edge associated with a rearward edge associated a second direction of the transportation assembly. The first and second directions can be opposing directions and likewise leading and rearward edges may be considered opposing edges of platform 18. The engine can be above the platform and aligned closest to the rearward edge of the platform while the cab can be aligned closest to the leading edge of the platform.

Self-leveling software which controls the positioning of platform 18 in relation to track 12 existing on support structure such as ground or earth can include processing circuitry that is coupled to both leveling sensor and hydraulic valves, and this processing circuitry can include a programmable logic controller coupled to clinometer sensors, for example. Example process circuitry can include "HB level logic", available through Bay Shore Systems, Inc., Rathdrum Id.

Associated with cab 14 can be operator controls and associated with cab 14 can be motors and compressors utilized to drive track 12 as well as manipulate the hydraulics associated with the extension assembly as well as the self-leveling of platform 18.

As can be seen in the Figures, extension assembly 16 can extend to a center portion above platform 18, not pivoting from the very front of cab but centered or even rear of cab 14 according to example implementations. A boom of the extension assembly can be pivotably attached above the platform closer to the rearward edge than the leading edge. The boom can be movable between a first position fully extended and a second position fully raised. (see, e.g., FIG. 4).

Figure 2:
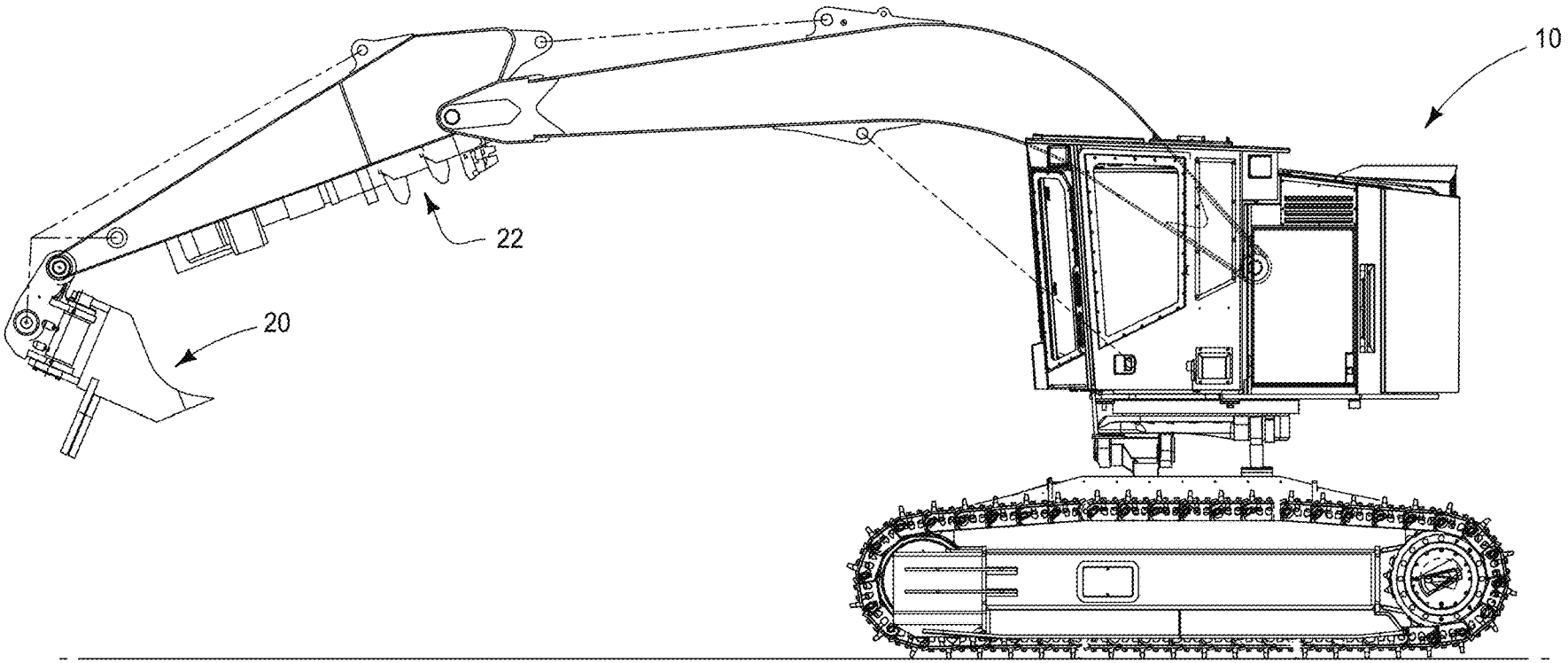
FIG. 2 is a depiction of the construction equipment of FIG. 1 in an alternative configuration according to an embodiment of the disclosure.

Referring next to FIG. 2, equipment 10 is shown in one configuration having extension assembly 16 extending directly in front of the cab. In accordance with example implementations the assembly can include at least two components, one can be a clamping or pole picking component as well as a bucket component 20 as well as a drill component 22 that is attached to the extension assembly 16. Extension assembly 16 can be in two components, a banana boom as well as an extension, and drill assembly 22 can extend from the extension of the banana boom.

Figure 3:
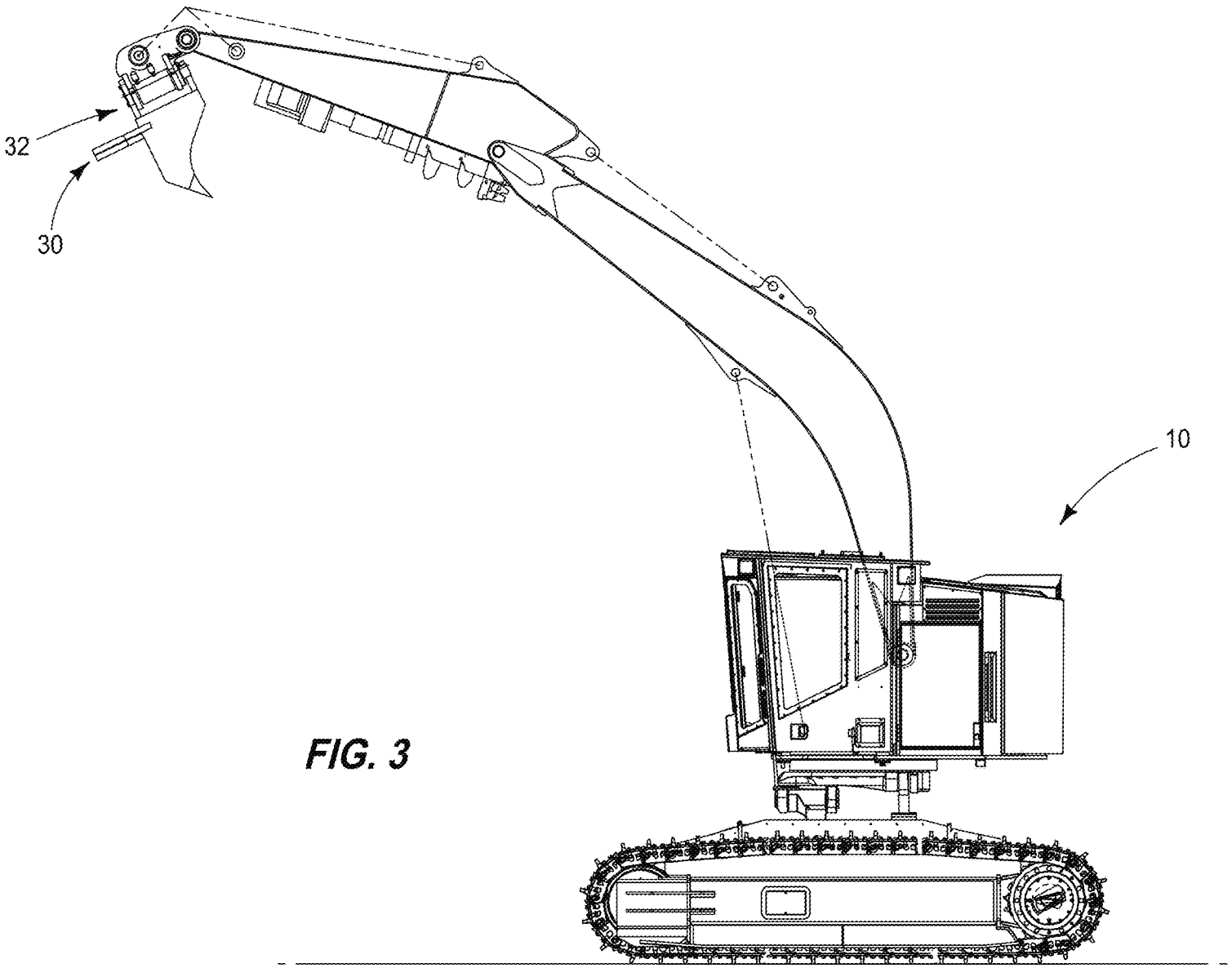
FIG. 3 depicts the construction equipment of FIG. 2 in an alternative configuration according to an embodiment of the disclosure.

Referring next to FIG. 3, as shown in an alternative configuration, the extension assembly 16 can be extended upwards and allow for the grasping of utility poles if necessary. These utility poles can be grasped utilizing the spindle component 32 which has claws of claw assembly 30 extending therefrom.

Figure 4:
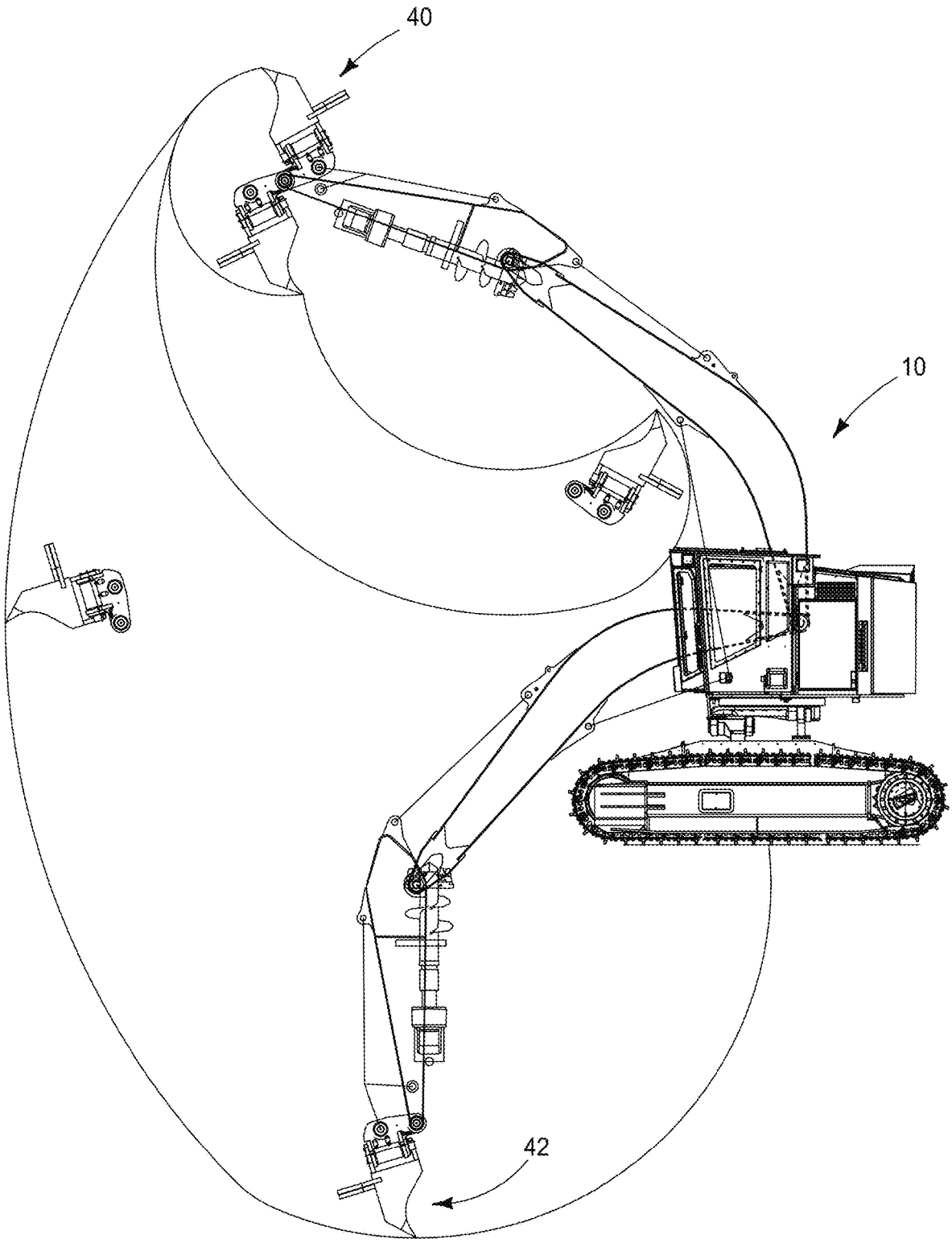
FIG. 4 depicts multiple configurations of construction equipment according to an embodiment of the disclosure.

Referring next to FIG. 4, equipment 10 is shown in at least two configurations with the extension assembly extending upwards to a point at 40 above ground level and also to a point at 42 below ground level. The extent of this reach can be obtained by using both the banana boom and the extensions in combination with the pivot point being located at the rearward portion of platform 18 for example. As shown the curve of the banana boom can extend beyond platform 18 in the first position when extending below ground level, and within a perimeter of outlined by the platform when extended above ground level in the second position.

Figure 5:
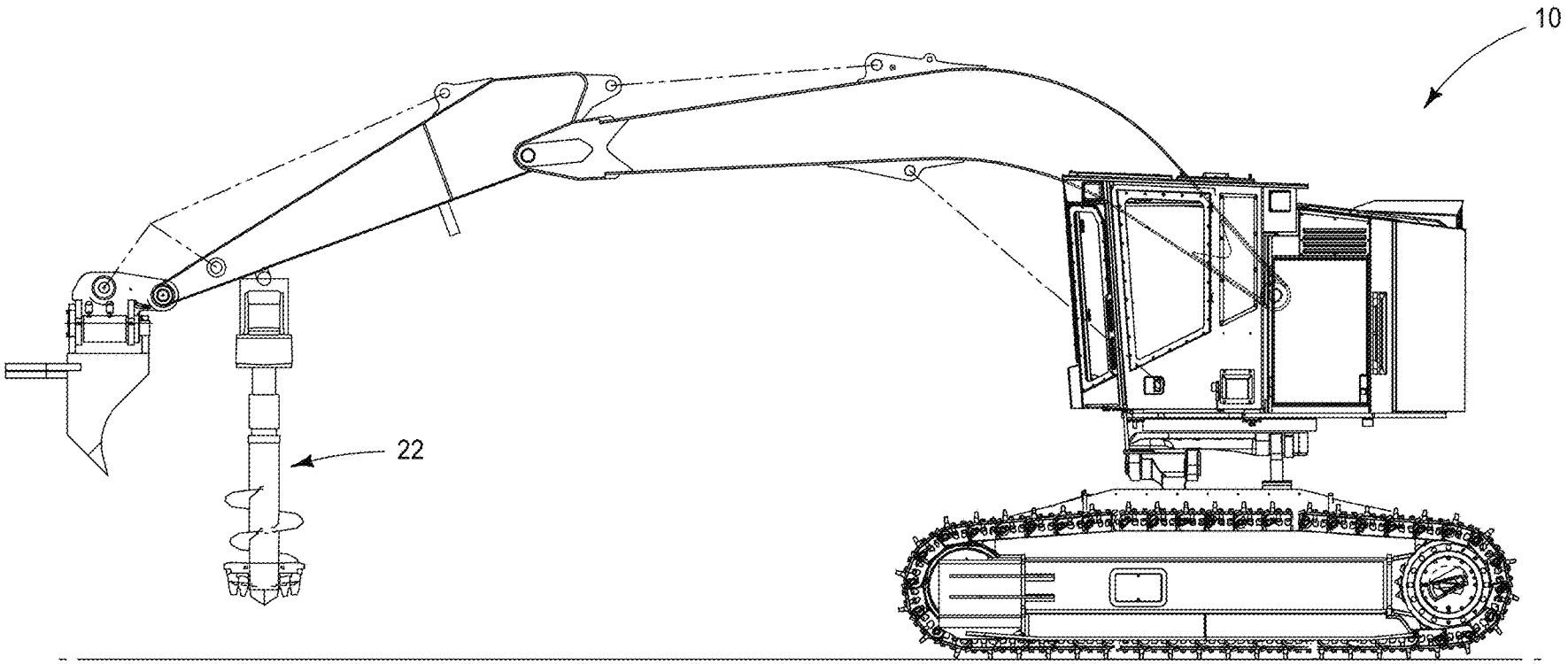
FIG. 5 depicts construction equipment in an alternative configuration according to an embodiment of the disclosure.

Referring next to FIG. 5, boring or drill assembly 22 is shown in the extended position in preparation for drilling openings that can be utilized for utility pole placement. As shown this drilling assembly can extend from extension assembly 16. Assembly 22 can be considered an earth auger assembly. Example Auger assemblies can include but are not limited to "LineEX Augers" available through Desco Drilling of Richmond Calif. This assembly can be pivotably coupled to the extension member and movable between a first position in parallel alignment with the extension member (see, e.g., FIG. 4) and second position in substantial normal alignment with the extension member (FIG. 5).

Figure 6:
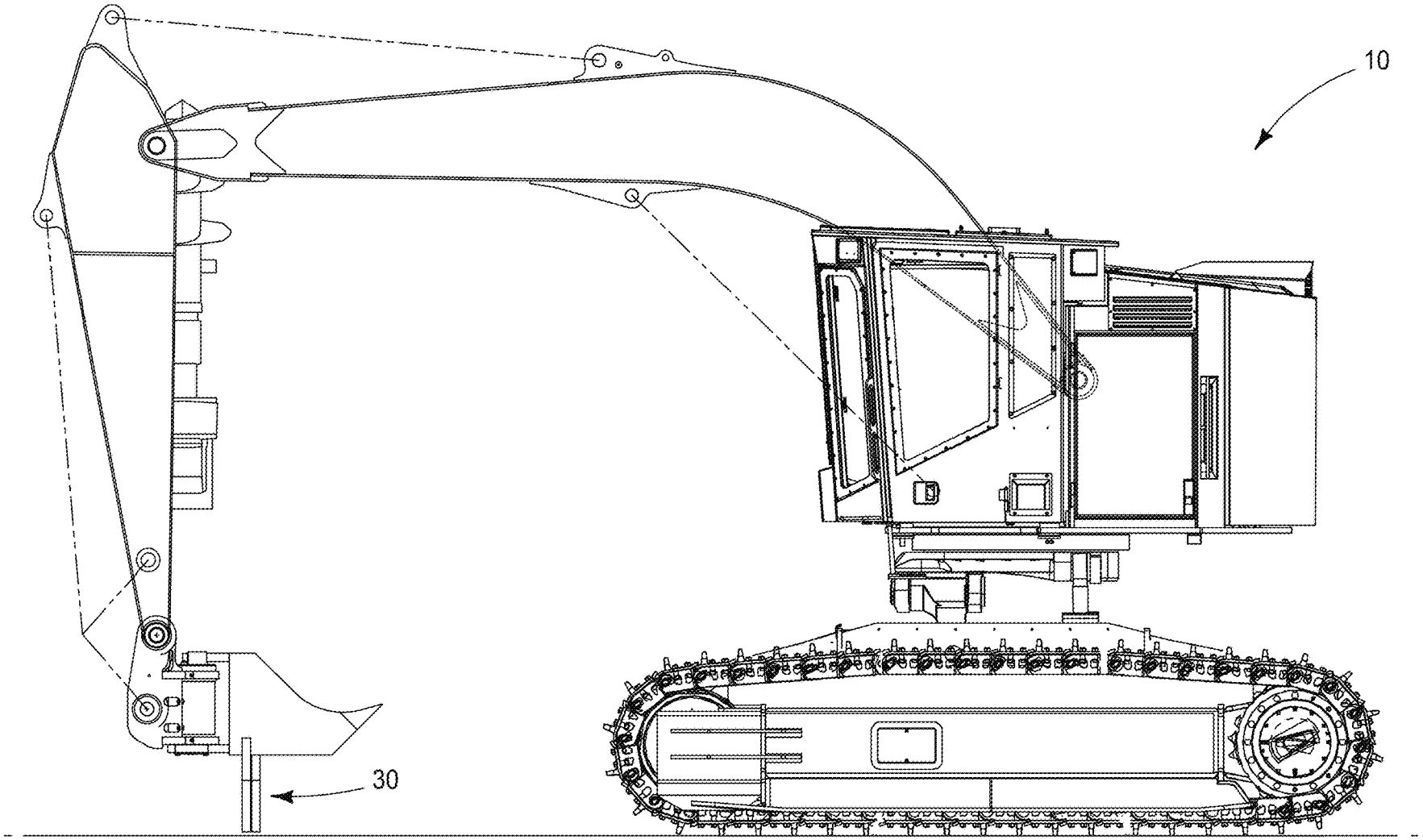
FIG. 6 depicts construction equipment according to another embodiment of the disclosure.
Figure 7:
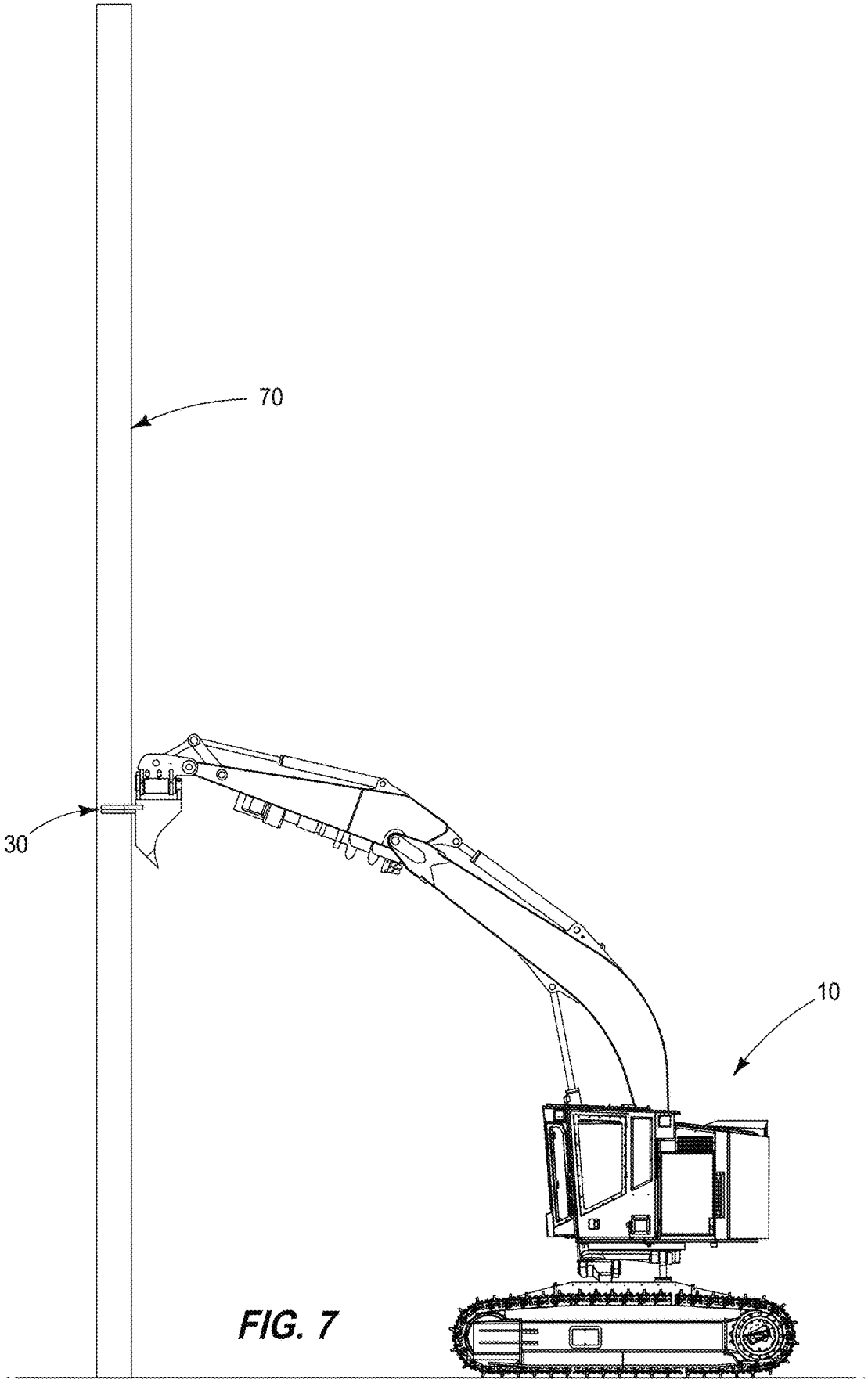
FIG. 7 depicts an alternative configuration of the construction equipment according to an embodiment of the disclosure

Referring next to FIG. 6, claw assembly 30 is in the pole pick up position in preparation for picking a pole from the ground and placement of the pole in an opening created by drill assembly 22. As shown in FIG. 7, pole 70 is in its supported position within claws of claw assembly 30 of equipment 10. Assembly 30 can be pivotably coupled to the terminus of the extension member of the extension assembly. Assembly 30 can be configured to rotate axially about the terminus of the extension member, but also rotate axially about an axis normal to the terminus of the extension member. Assembly 30 can be operatively engaged with the terminus of the extension member via a spindle assembly.

Figure 8:
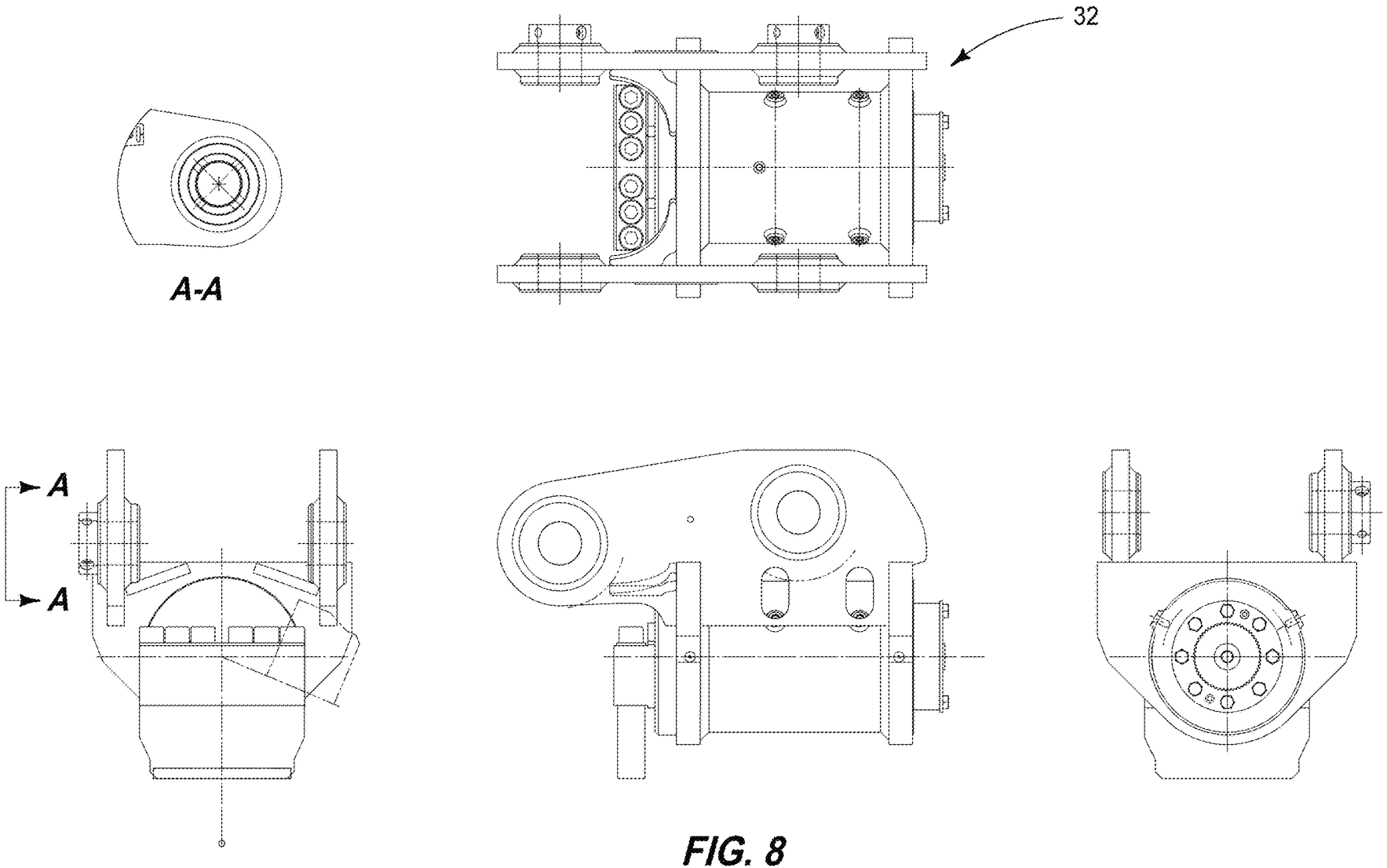
FIG. 8 depicts a component of the construction equipment of the present disclosure according to an embodiment of the disclosure.
Figure 8A:
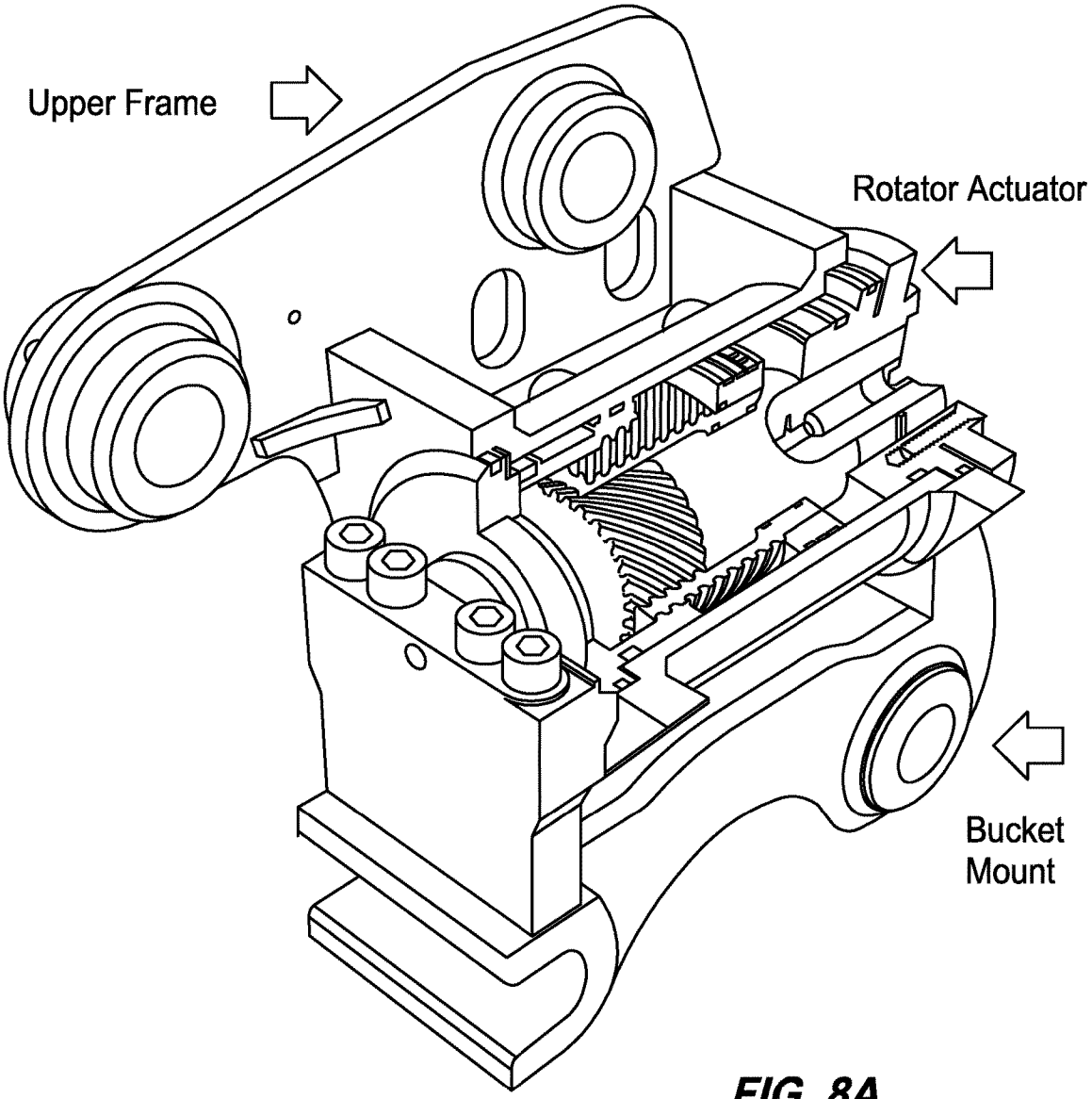
FIG. 8A is another depiction of the component of FIG. 8.

Referring to FIG. 8, the spindle assembly 32 is depicted that allows for both the claw picking of poles as well as the transportation of poles from a lengthwise to a normal degree in relation to the extensions assembly. Accordingly, utility poles can be rotated about one axis at least about 90 degrees within one plane, and rotated about another axis at least 90 degrees in another plane. (see, e.g., FIG. 12)

Figure 9A:
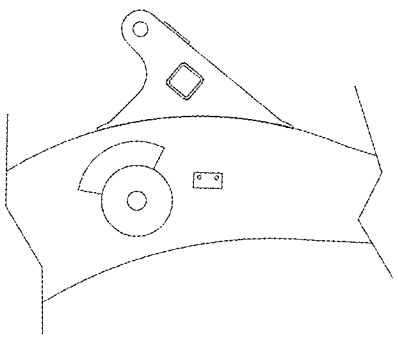
FIGS. 9 and 9A depict a component of the construction equipment according to an embodiment of the disclosure.
Figure 9:
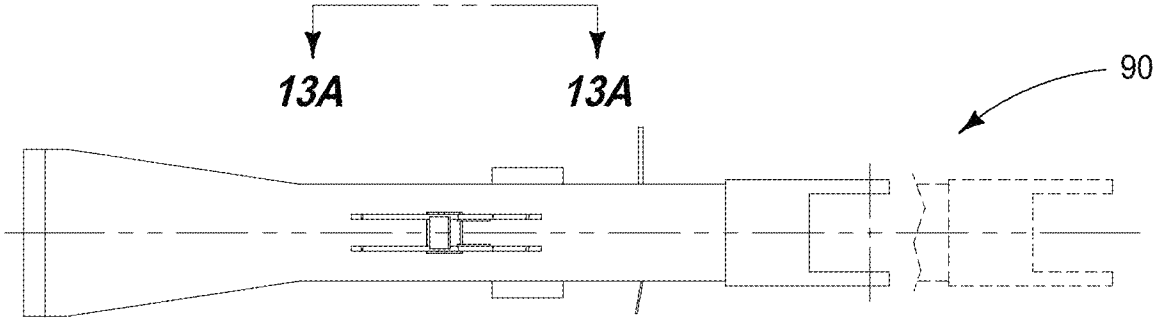
Figure 10:
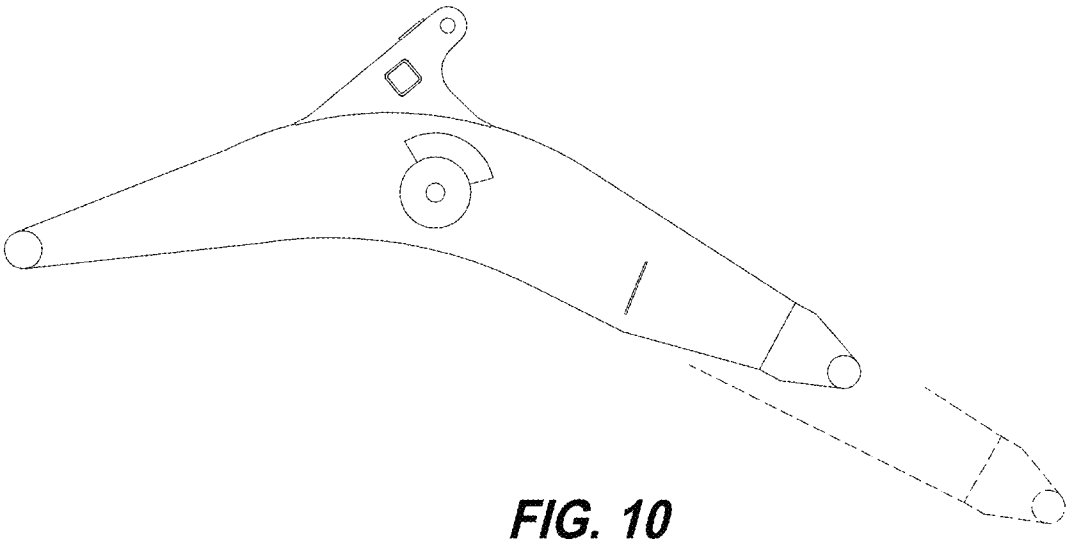
FIG. 10 depicts another component of the construction equipment according to an embodiment of the disclosure.
Figure 11:
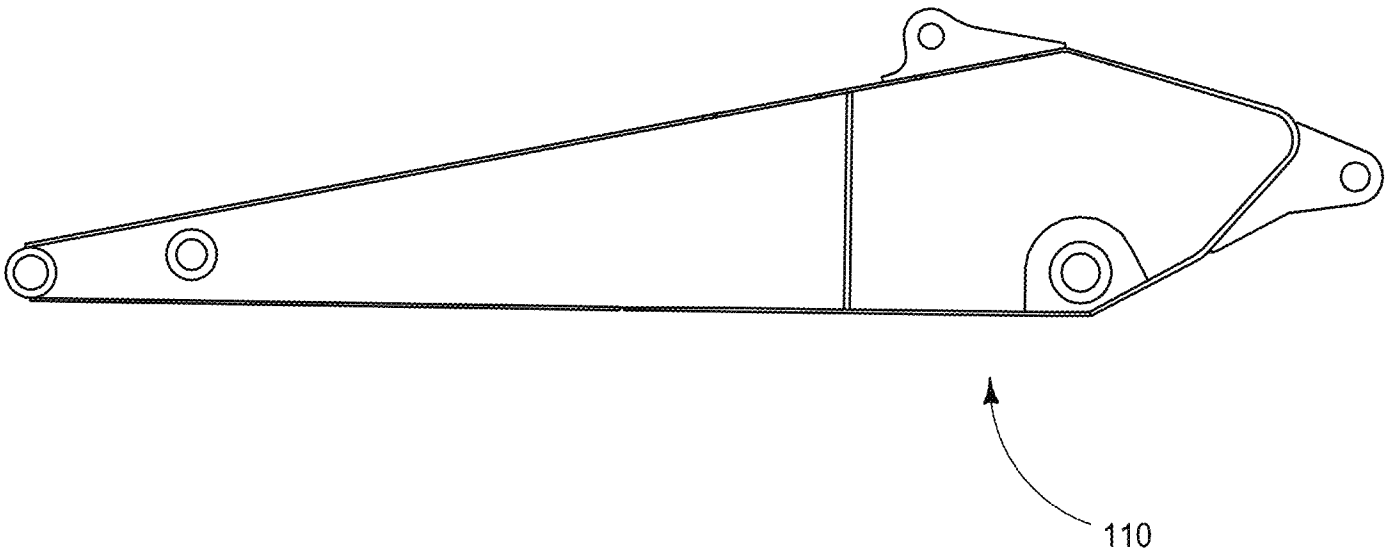
FIG. 11 depicts another component of the construction equipment. according to an embodiment of the disclosure.

Referring to FIGS. 9 through 11, extension assembly components are shown that can include banana boom 90 as well as extensions 110 for example.

Figure 12:
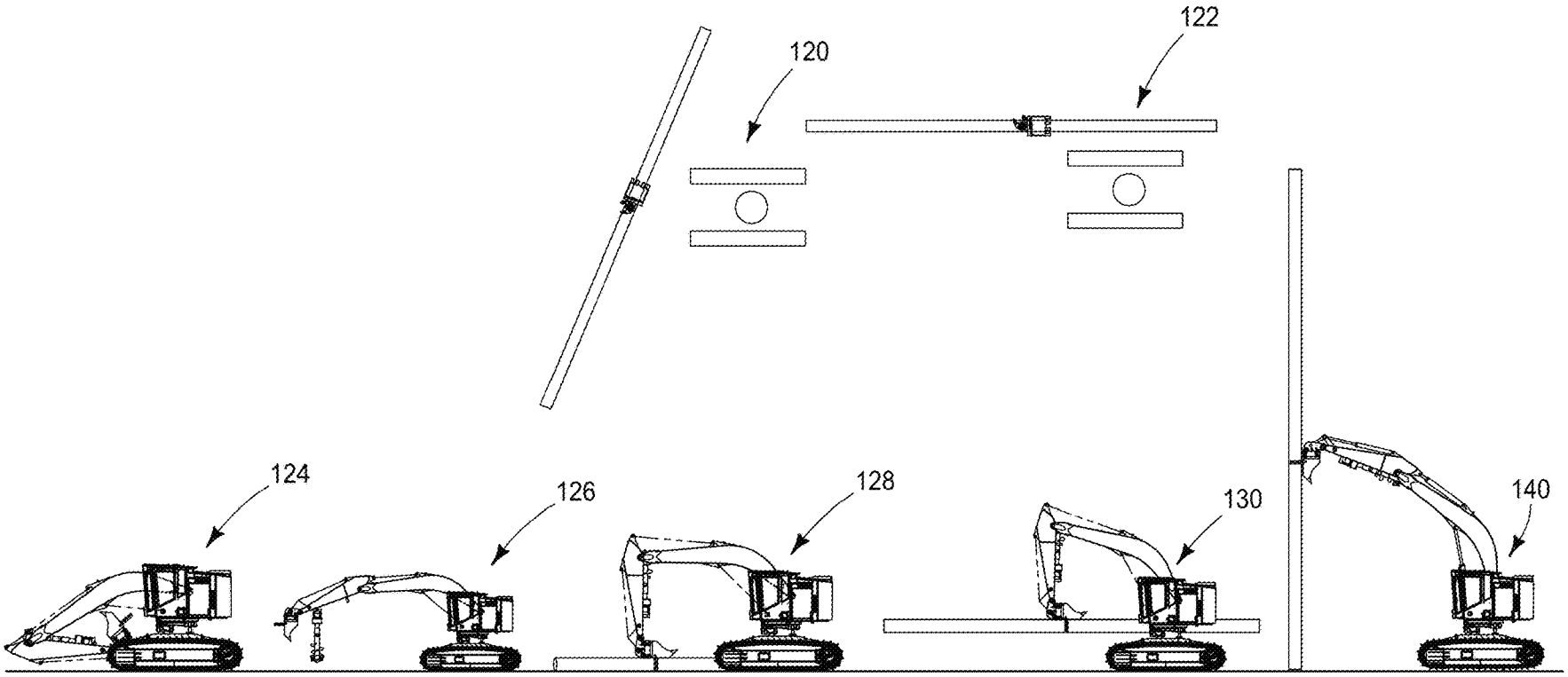
FIG. 12 depicts a series of configurations of the construction equipment according to an embodiment of the disclosure.

Referring next to FIG. 12, in a series of depictions, equipment 10 is shown. Referring first to a top view 120 and 122, the rotation of the spindle assembly allows for the turning or carrying of the utility pole in relation to tracks and also the rotation of a cab and the rotation of the spindles allow for the side carrying of the utility poles. This can be beneficial when traversing utility pole line paths which are relatively thin in relation to roads and or other passageways.

As can be seen in configurations 124 through 140, equipment 10 can be in the transport position and move to the hole digging position, then to the pole picking and placement positions.

Figure 13:
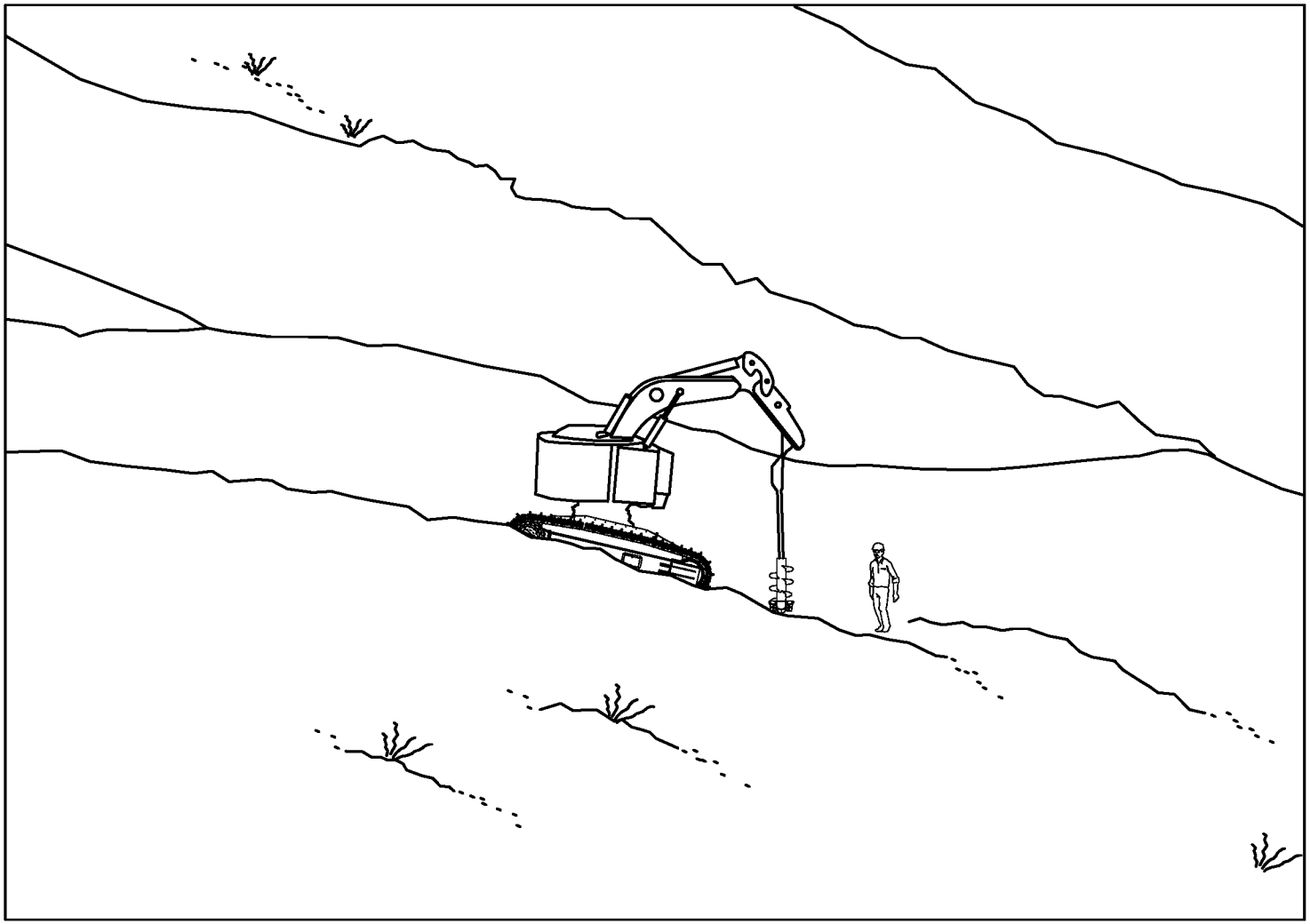
FIG. 13 depicts the construction equipment in an actual setting according to an embodiment of the disclosure.
Figure 14:
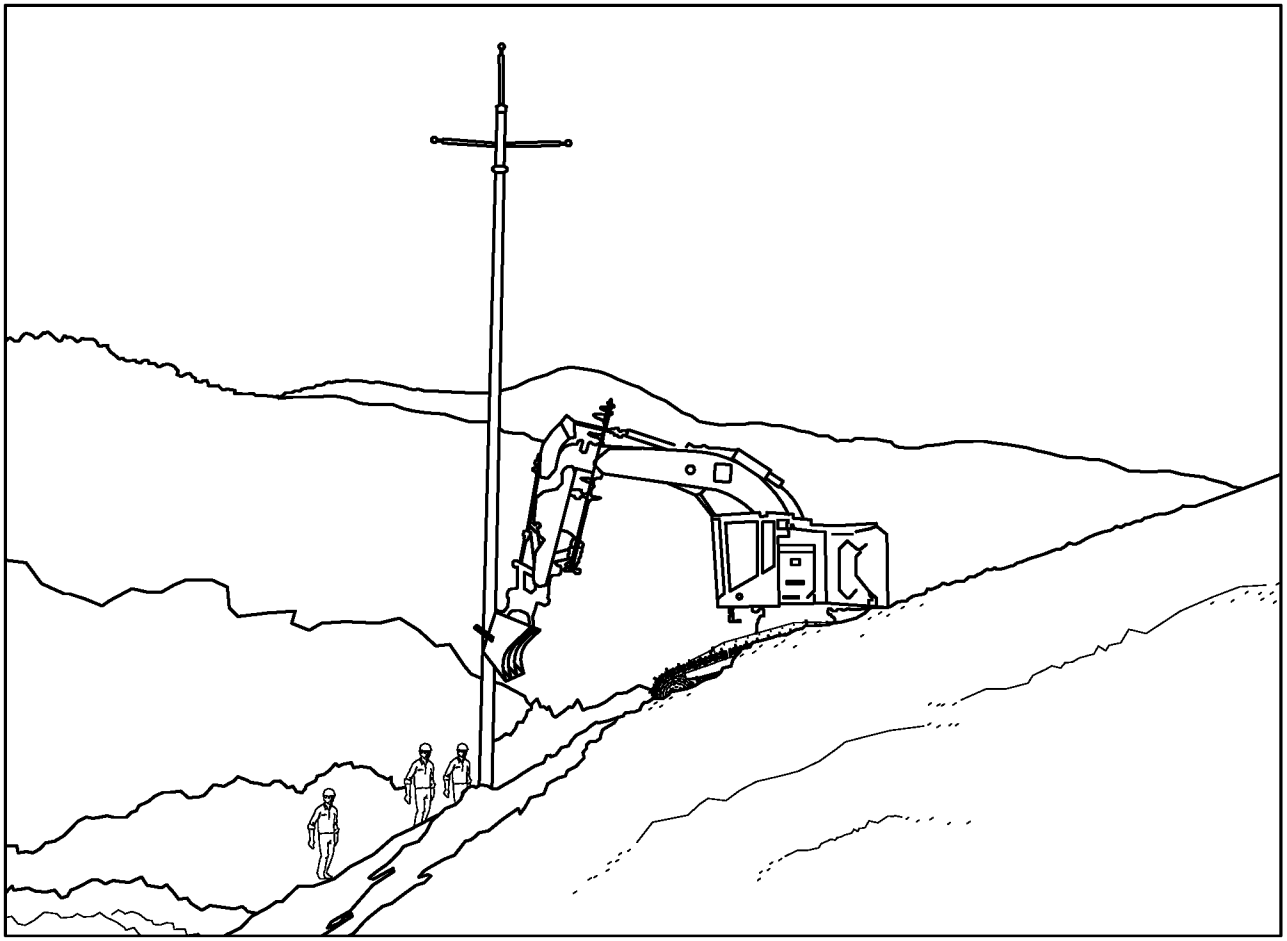
FIG. 14 depicts construction equipment according to an embodiment of the disclosure

As can be seen in FIGS. 13 and 14, equipment 10 is quite useful when digging poles on rough terrain. As can be seen in both FIGS. 13 and 14, despite the elevation change between the track or platform surface and the utility pole placement, equipment 10 is able to dig openings for utility poles on substantial grades as well as place utility poles in the same grades.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

The invention claimed is:

1. Construction equipment comprising:

a transport assembly operably supporting a platform, the platform having a leading edge opposing a rearward edge, the leading edge associated with a first direction of the transport assembly, and the rearward edge associated with a second direction of the transport assembly;

an operator cab above the platform and aligned closer to the leading edge than the rearward edge;

an engine above the platform and aligned closer to the rearward edge than the leading edge;

a banana boom pivotably attached above the platform closer to the rearward edge than the leading edge, the boom being movable between a first position fully extended to engage with the leading edge of the platform and a second position fully raised;

a fixed length extension member pivotably coupled to the banana boom;

a bucket/claw assembly pivotably coupled to an end of the extension member; and an earth auger assembly pivotably coupled to the fixed length extension member proximate the bucket/claw assembly, the earth auger being movable between a first position in parallel alignment with the fixed length extension member with an auger end proximate the pivotable coupling to the banana boom, and a second position in substantial normal alignment with the extension member.

2. The construction equipment of claim 1 wherein a curve of the banana boom extends beyond the platform in the first position.

3. The construction equipment of claim 1 wherein the claw assembly is operably engaged with the end of the extension member via a spindle assembly.

* * * * *